US005184896A

United States Patent [19]

Hammond et al.

[11] Patent Number: 5,184,896

[45] Date of Patent: Feb. 9, 1993

[54] SELF-EXPANDING FLEXIBLE POUCH INCLUDING IMPROVED EXTENSIBLE STAY TO MAXIMIZE OPENING

[75] Inventors: Edward P. Hammond; Daniel J. Kinne, both of Cincinnati; George L. Roseberry, Fairfield, all of Ohio

[73] Assignee: The Procter & Gamble Company, Cincinnati, Ohio

[21] Appl. No.: 774,672

[22] Filed: Oct. 11, 1991

[51] Int. Cl.[5] ..... B65D 33/00

[52] U.S. Cl. ..... 385/33; 383/34; 383/35; 383/209; 383/104; 383/120

[58] Field of Search ..... 383/33, 34, 34.1, 35, 383/43, 209, 104, 120

[56] References Cited

U.S. PATENT DOCUMENTS

| | | | |
|---|---|---|---|
| 1,338,375 | 4/1920 | Kleidman . | |
| 1,403,414 | 1/1922 | Hohein . | |
| 1,413,079 | 4/1922 | Waid . | |
| 1,513,395 | 10/1924 | Holmes . | |
| 1,798,945 | 3/1931 | Lamarthe . | |
| 1,973,956 | 9/1934 | Hickman . | |
| 2,080,402 | 5/1937 | Herman . | |
| 2,093,976 | 9/1937 | Farmer . | |
| 2,150,627 | 3/1939 | Lieber . | |
| 2,158,955 | 5/1939 | Blacher . | |
| 2,227,390 | 12/1940 | Green . | |
| 2,232,888 | 2/1941 | Schimelmitz . | |
| 2,241,612 | 5/1941 | Norris . | |
| 2,498,202 | 2/1950 | Dinman . | |
| 2,637,410 | 5/1953 | Martin et al. | 383/34 X |
| 2,654,892 | 10/1953 | Szabo . | |
| 2,792,168 | 5/1957 | Garcon . | |
| 2,873,905 | 2/1959 | Denton . | |
| 3,189,253 | 6/1965 | Monjonnier . | |
| 3,272,248 | 9/1966 | O'Farrell . | |
| 3,310,224 | 3/1967 | Laguerre . | |
| 3,334,804 | 8/1967 | Watts . | |
| 3,346,883 | 10/1967 | Ersek . | |
| 3,380,646 | 4/1968 | Doyen et al. . | |
| 3,406,853 | 10/1968 | McLeod | 383/35 X |
| 3,412,918 | 11/1968 | Sherman . | |
| 3,426,958 | 2/1969 | Gore . | |
| 3,463,381 | 8/1969 | Wainberg . | |
| 3,542,190 | 11/1970 | Keller . | |

(List continued on next page.)

FOREIGN PATENT DOCUMENTS

| | | |
|---|---|---|
| 201257 | 4/1985 | European Pat. Off. . |
| 345930 | 12/1989 | European Pat. Off. . |
| 17656 | 9/1898 | Fed. Rep. of Germany . |

(List continued on next page.)

*Primary Examiner*—Allan N. Shoap
*Assistant Examiner*—Jes F. Pascua
*Attorney, Agent, or Firm*—Kevin C. Johnson; E. Kelly Linman; Michael E. Hilton

[57] ABSTRACT

A self-expanding flexible pouch that can be used as the measuring device for reconstituting a concentrated product contained therein. The pouch includes an improved one-piece extensible stay located in the throat area of the flexible pouch that is biased toward a relaxed, expanded, circular configuration but is initially held substantially flat in a stressed condition by the sealed top portion of the pouch. When the top portion of the pouch is removed, the improved stay expands to its relaxed, expanded configuration and thereby expands and opens the throat area of the pouch. The improved stay comprises a one-piece, continuous extensible loop having a pair of opposed hinges. The hinges are thinner in thickness than the remaining portions of the loop and aligned with the side peripheral edges of the pouch. Two opposed thick-walled sections are located between the opposed hinges. The opposed thick-walled sections provide the automatic opening force for the pouch. The thick-walled sections are substantially aligned with and secured in fixed relation to the front and back sidewall panels of the pouch. Two ribs are located on said opposed thick-walled sections to prevent the stay from sticking together. Four thin-walled transition sections are preferably employed to connect the hinges to the thick-walled sections to form the loop. The thin-walled transition sections are thinner in thickness than the thick-walled sections.

20 Claims, 2 Drawing Sheets

U.S. PATENT DOCUMENTS

| | | | |
|---|---|---|---|
| 3,635,376 | 1/1972 | Hellstrom . | |
| 3,684,156 | 8/1972 | Fettinger et al. | 383/104 X |
| 3,734,154 | 5/1973 | Polk . | |
| 3,759,439 | 9/1973 | Cross et al. . | |
| 3,782,601 | 1/1974 | Krawagna . | |
| 3,790,744 | 2/1974 | Bowen . | |
| 3,817,434 | 6/1974 | Dickman . | |
| 3,909,582 | 9/1975 | Bowen . | |
| 4,141,399 | 2/1979 | Zoland . | |
| 4,196,034 | 4/1980 | Kimura . | |
| 4,290,467 | 9/1981 | Schmidt . | |
| 4,317,478 | 3/1982 | Babbidge . | |
| 4,454,979 | 6/1984 | Ikeda et al. . | |
| 4,471,875 | 9/1984 | Hain et al. . | |
| 4,498,591 | 2/1985 | Smith | 383/35 X |
| 4,541,117 | 9/1985 | Ashbeck . | |
| 4,593,408 | 6/1986 | Drobish et al. . | |
| 4,617,683 | 10/1986 | Christoff . | |
| 4,618,383 | 10/1986 | Herrington . | |
| 4,621,000 | 11/1986 | Frick . | |
| 4,634,006 | 1/1987 | Yanase . | |
| 4,655,862 | 4/1987 | Christoff et al. . | |
| 4,691,372 | 9/1987 | Van Arden . | |
| 4,709,533 | 12/1987 | Ausnit . | |
| 4,718,738 | 1/1988 | Bell . | |
| 4,753,489 | 6/1988 | Mochizuki | 383/33 |
| 4,756,917 | 7/1988 | Kamada et al. . | |
| 4,815,866 | 3/1989 | Martone | 383/34.1 |
| 4,837,849 | 6/1989 | Erickson et al. . | |
| 4,898,477 | 2/1990 | Cox et al. | 383/33 |
| 4,909,017 | 3/1990 | McMahon et al. . | |
| 4,925,316 | 5/1990 | Van Erden et al. . | |
| 4,954,124 | 9/1990 | Erickson et al. . | |
| 4,986,673 | 1/1991 | Bell . | |
| 5,044,774 | 9/1991 | Bullard et al. | 383/34.1 |

FOREIGN PATENT DOCUMENTS

| | | | |
|---|---|---|---|
| 2635366 | 2/1978 | Fed. Rep. of Germany . | |
| 770209 | 9/1934 | France . | |
| 637845 | 4/1962 | Italy | 383/34 |
| 0308754 | 12/1989 | Japan . | |
| WO91/18797 | 12/1991 | PCT Int'l Appl. . | |

SELF-EXPANDING FLEXIBLE POUCH INCLUDING IMPROVED EXTENSIBLE STAY TO MAXIMIZE OPENING

FIELD OF THE INVENTION

The present invention relates to flexible packaging pouches, and more particularly relates to extensible stays in flexible packaging pouches that self-expand after opening.

BACKGROUND OF THE INVENTION

Many products are shipped and sold in concentrated form to reduce shipping costs, storage space, and shelf space. For example, in the case of citrus juice and other beverages, it is cost effective to first concentrate the product by removing a substantial portion of the juice's water volume at the point of manufacture, and then ship it to the place of sale in concentrated form. Many different types of containers are used to package concentrated products. For example, composite foil-fiber cans are widely used to package concentrated citrus and other fruit juices. However, these cans are expensive to make, difficult to open, and it is difficult to remove the content because the can's rigid sidewalls cannot be easily squeezed to "milk" the product out. One advantage of the foil-fiber can is that after the can's contents have been removed, it can be conveniently used as the means for accurately measuring the amount of water that needs to be added to the beverage concentrate for proper reconstitution.

Flexible pouches are an example of another type of container used to package concentrated products. The flexible pouches are made of two superimposed flexible films that are sealed together about their peripheral edges and therefore relatively easy and inexpensive to make. However, it has been found that consumers generally do not use the empty pouch as the means for measuring the amount of fluid that needs to be added to the concentrated product, but instead use a separate device such as a rigid measuring cup. It is believed that this habit is primarily because such pouches are flexible and therefore difficult to grasp and pour from with confidence that the pouch will not collapse when the pouch is full of fluid. Commonly assigned U.S. Pat. No. 4,898,477 issued to Cox et al. on Feb. 6, 1990 and which is hereby incorporated herein by reference discloses a self-expanding flexible pouch that can be used as a measuring device for reconstituting a concentrated product contained within the flexible pouch. The flexible pouch includes an extensible stay located in the throat area of the pouch. When the pouch's top portion is removed, the extensible stay expands, thus opening the pouch's throat area. The consumer can then "milk" the concentrated product out of the flexible pouch. The opening of the pouch's throat area allows the consumer to reconstitute the fluid by adding water to the pouch and then pouring and mixing the concentrated substance previously "milked" from the pouch. The Cox et al. pouch has the advantage of self-expansion of the pouch's throat area after removal of the pouch's top portion. The pouch disclosed in Cox et al. works quite well in expanding the throat area of the pouch after initial opening. However, if the self-expansion tendencies of the Cox et al. pouch's throat area could be increased, it would aid the consumer in removal of the product from the flexible pouch and during the reconstituting process.

Accordingly, it is an object of the present invention to provide an extensible stay creating greater self-expansion tendencies in the flexible pouch's throat area;

It is further an object of the present invention to provide an extensible stay that will assume a predetermined configuration upon opening;

It is further an object of the present invention to provide an extensible stay that is easy to assemble;

It is still another object of the present invention to provide an extensible stay that accomplishes the aforementioned objectives at minimal cost.

SUMMARY OF THE INVENTION

Flexible pouches having an extensible stay that expands the pouch's throat area upon opening are particularly useful in packaging concentrated products that need to be reconstituted with a fluid at the point of end use. In a preferred embodiment of the present invention a sealed, self-expanding, flexible pouch has front and back sidewall portions which are superimposed upon one another with their innermost surfaces sealed together along centrally located portions of their side peripheral edges to form the body portion of the pouch. Their innermost surfaces are also sealed together along their top peripheral edge and along the uppermost portion of their side peripheral edges to form a top portion of the pouch. Their innermost surfaces are secured in sealed relation to one another along their bottom peripheral edges and along the lowermost portion of their side peripheral edges to form a bottom portion of the pouch. The pouch has a throat area located subjacent to the top portion of the pouch. A continuous, one-piece extensible stay is secured in fixed relation to the innermost surfaces of the front and back sidewall panels in the throat area of the pouch. The continuous, one-piece extensible stay has a relaxed, expanded configuration and a stressed, collapsed configuration. The stay is initially held in its stressed, collapsed configuration by the top portion of the pouch prior to removal of the top portion of the pouch. The stay expands to its relaxed, expanded configuration when the top portion of the pouch is removed, thereby automatically expanding the throat area of the pouch to an open configuration. The improved stay comprises a continuous one-piece extensible loop that has a pair of opposed hinges. The hinges are thinner in thickness than the remaining portions of the loop and are aligned with the side peripheral edges of the pouch. A pair of opposed thick-walled sections are located between the opposed hinges. The opposed thick-walled sections provide the initial automatic opening force for the pouch. One of the thick-walled sections is substantially aligned with the front sidewall panel of the pouch and the other thick-walled section is substantially aligned with the back sidewall panel of the pouch. The opposing ends of each of the thick-walled sections are connected to one of the hinges in the extensible loop by a thin-walled transition section having a maximum thickness which is less than the minimum thickness of the thick-walled sections.

In a particularly preferred embodiment of the present invention, the bottom portion of the pouch is provided with a bottom gusset panel whose peripheral edges are attached to the inner surface of the sidewall panels. The gusset panel's mid-section is preferably folded into a pleated arrangement and extends freely up into the interior of the pouch.

In a particularly preferred embodiment of the present invention, at least one line of weakness is provided in the front and back sidewall panels below the top peripheral seal and above the stays to facilitate easy opening without an opening utensil.

In a particularly preferred embodiment of the present invention, at least one rib is provided on the opposed thick-walled sections to prevent the stay from sticking together.

In use, a consumer grasps the pouch and removes the pouch's top portion with scissors or other utensil, or by tearing the pouch along the line of weakness if provided. After the pouch's top portion has been removed the extensible stay self-expands to its relaxed, expanded configuration, thereby spreading the pouch's throat area into a generally flattened tubular configuration. After the pouch's contents are emptied into a large container, the consumer uses the now empty pouch as the means for measuring the amount of reconstituting fluid that needs to be added. When this fluid is placed within the pouch the hydrostatic pressure of the fluid causes the pouch's throat area to further expand to a generally tubular configuration while the pouch's bottom gusset panel unfolds and allows the pouch's bottom section to also expand into a generally tubular configuration. The pouch overall has then assumed a predetermined, generally tubular configuration with a predictable and repeatable internal volume such that it can be conveniently used as the means for accurately measuring the amount of fluid necessary for properly reconstituting the concentrated product.

Self-expanding pouches of the present invention are also particularly useful in packaging non-concentrated, i.e., single-strength products such as liquid fruit juice beverages. When the pouch's top section is removed, the pouch's throat area and bottom portion expand to give the pouch an overall tubular configuration from which a consumer may conveniently drink the beverage contained therein.

BRIEF DESCRIPTION OF THE DRAWINGS

While the specification concludes with claims which particularly point out and distinctly claim the invention, it is believed that the present invention will be better understood from the following description of preferred embodiments, taken in conjunction with the accompanying drawings, in which like reference numerals identify identical elements and wherein:

DESCRIPTION OF THE PREFERRED EMBODIMENT

It should be noted that although the following detailed description and illustration are generally directed to flexible pouches for containing a concentrated product such as a citrus or other fruit juice concentrate, the present invention may be applied with equal facility in containing other types of concentrated and unconcentrated products such as, but not limited to, dry or powdered beverages, liquid or frozen single-strength beverages, food products such as dry soups, dry and instant cereals, salted snacks, baking mixes, cooking oils and other dry foodstuffs; medications, cold remedies, mouth washes, laundry soaps and softeners, adhesives, paints, and hard surface cleaners.

Figure 1:
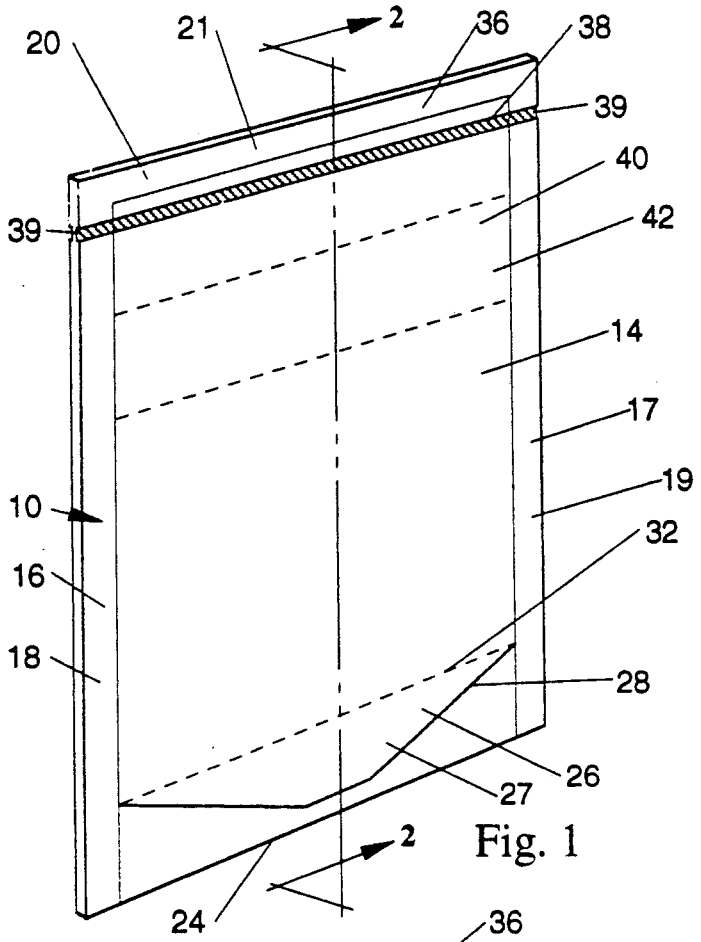
FIG. 1 is a schematic, perspective view of a flexible pouch of the present invention shown with some of the pouch's internal features illustrated in phantom.
Figure 2:
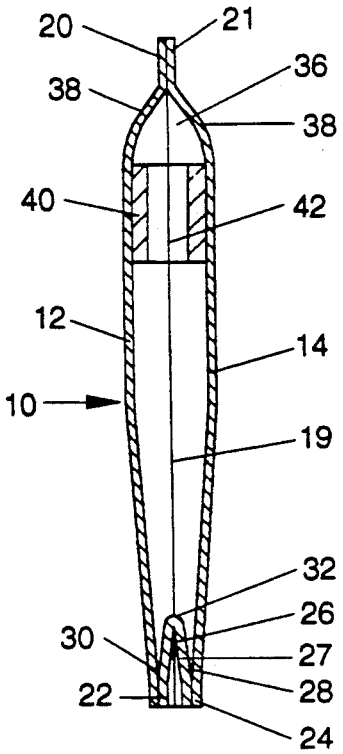
FIG. 2 is a schematic, cross-sectional side view of the flexible pouch illustrated in FIG. 1 taken along section line 2—2.

With reference to the drawings wherein the same numeral is used to indicate common components, FIGS. 1 and 2 illustrate a self-expanding flexible pouch of the present invention generally indicated as 10. The pouch 10 is similar to the pouch disclosed in FIGS. 1 through 5B of the commonly assigned U.S. Pat. No. 4,898,477 issued to Cox et al. on Feb. 6, 1990, which is incorporated herein by reference. Cox et al. teaches using a single piece stay having a uniform thickness. However, one difficulty which has been encountered with a uniform thickness single piece stay is that it does not maximize automatic expansion of the pouch's throat area. Applicants have found a way to further improve automatic expansion of the pouch's throat area by providing an improved single piece stay with thick-walled sections, thin-walled transition sections, and hinges, as described hereinafter. The pouch 10 includes flexible sidewall panels 12 and 14 which are superimposed over one another and sealed together, e.g., heat-sealed, along side peripheral edges 16 and 17 to form side seals 18 and 19, respectively. Side seals 18 and 19 form body portion 15 of pouch 10. The sidewall panels 12 and 14 are also sealed together along top peripheral edge 20 to form top seal 21. The uppermost portion of the side seals 18 and 19 together with top seal 21 form top portion 36 of pouch 10. Bottom peripheral edges 22 and 24 of sidewall panels 12 and 14, respectively, can also be sealed to one another to form a bottom seal and thereby complete a closed pouch structure. This bottom seal along with the lowermost portion of side seals 18 and 19 form the bottom portion 27 of pouch 10. However, in a particularly preferred embodiment of the present invention illustrated in FIGS. 1 and 2, bottom gusset panel 26 (shown in phantom in FIG. 1) is attached to the inner surface of sidewall panels 12 and 14 in bottom portion 27 of pouch 10 along generally arcuate seal lines 28 and 30, respectively, and preferably also in the area therebelow. In this particularly preferred embodiment, the lowermost portion of side seals 18 and 19 along with bottom gusset panel 26 form the bottom portion 27 of the pouch. The portion of bottom gusset panel 26 above seal lines 28 and 30 is not attached to the inner surface of sidewalls 12 and 14 such that midsection 32 of gusset 26 is free and extends up into the interior of pouch 10 in a pleated fashion as best seen in FIG. 2. Alternatively, gusset 26 and sidewalls 12 and 14 can be made from the same web of material. Gusset 26 can be formed by folding the bottom portion of the continuous web in a "W" section as disclosed in U.S. Pat. No. 3,380,646 issued to Doyen et al. on Apr. 30, 1968 and which is hereby incorporated herein by reference.

Top portion 36 of pouch 10 is preferably provided with a line of weakness 38 that extends laterally across both sidewall panels 12 and 14 in close proximity to but below top peripheral seal 21. Line of weakness 38 may be formed by, for example, perforating or scoring sidewall panels 12 and 14 with a laser or knife either individually before sidewall panels 12 and 14 are sealed together, or collectively after they have been sealed together. One or both ends of line of weakness 38 preferably terminates with a notch or slit 39, which provides a stress concentration and aids in starting a tear along line of weakness 38 when pouch 10 is opened by a consumer.

In a particularly preferred embodiment of the present invention, line of weakness 38 is partially formed in various selected layers of barrier laminate structure from which sidewall panels 12 and 14 are made. The barrier laminate structure of sidewall panels 12 and 14 is disclosed in commonly assigned U.S. Pat. No. 4,898,477 issued to Cox et al. on Feb. 6, 1990, and which is incorporated herein by reference. This selective weakening of various layers, preferably the outer layers of sidewall panels 12 and 14 may be accomplished by various means well known in the art. For example, using a beam of radiant energy emitted from a laser such as that generally described in U.S. Pat. Nos. 3,790,744 and 3,909,582, both of said patents being hereby incorporated herein by reference. It has been found that if the line of weakness 38 is formed individually in sidewall panels 12 and 14 while they are in the form of continuous running webs prior to sealing, then very strict web control should be used to ensure that the line of weakness cut in one web aligns with the other line of weakness cut in the other web when the webs are superimposed. Alternatively, it has been found that much less stringent web control can be used if two or more lines of weakness spaced approximately 0.125 inches from one another are scored in each sidewall to ensure that one weakness line in one sidewall will substantially align with one of the lines of weakness scored in the other sidewall when the webs are superimposed.

Figure 3:
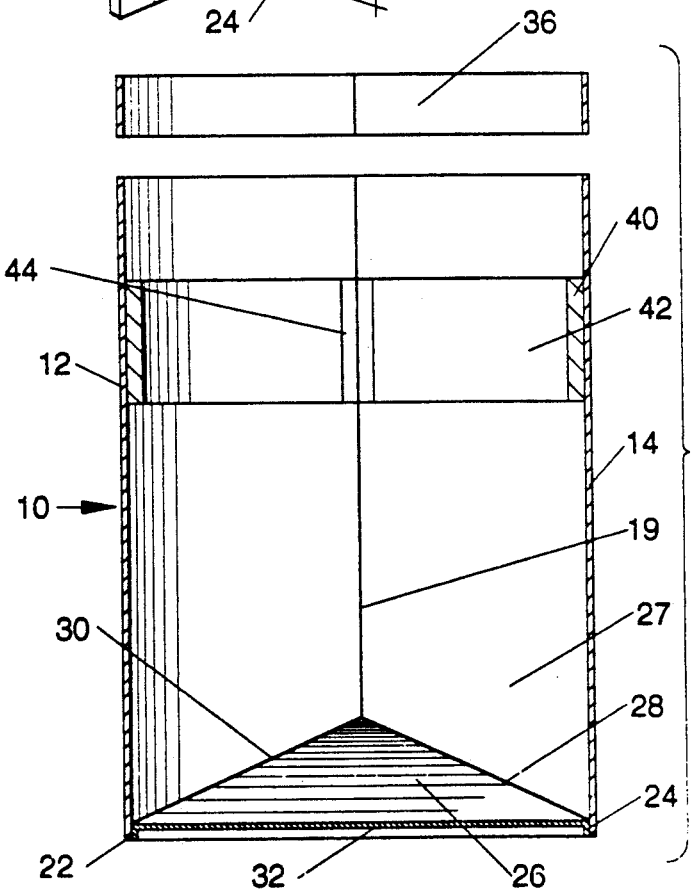
FIG. 3 is a schematic, cross-sectional side view of the flexible pouch illustrated in FIG. 1 taken at a point corresponding to section line 2—2, except that the pouch is shown with its top section removed and in its expanded configuration.

Still referring to FIGS. 1, 2, and 3, extensible stay 40 (shown in phantom in FIG. 1) is located in throat area 42 of pouch 10 and attached to the inner surface of sidewall panels 12 and 14 by using, for example, heat and pressure, a double sided adhesive tape, glue, or mechanical fastening means. Stay 40, described below, is preferably made of a relatively stiff resilient material having a memory, such as nylon or high density polyethylene (HDPE). The term "memory" is intended to mean the phenomenon where a material exhibits a tendency to return to its original, unstressed configuration after having been deformed to a stressed configuration and the deforming force has been removed. When extensible stay 40 is secured inside sealed pouch 10 as shown in FIGS. 1 and 2, top seal 21, sidewall panels 12 and 14, and the upper portions of side seals 18 and 19 cooperate in holding extensible stay 40 in its collapsed, stressed configuration.

Included below are the dimensions to a preferred execution of extensible stay 40. The dimensions given for stay 40 correspond to a working model of pouch 10 having a height of 7.00 inches and a width of 4.375 inches. It is understood, however, that these dimensions may be changed in order to conform to a pouch 10 having dimensions different than those disclosed.

Figure 5:
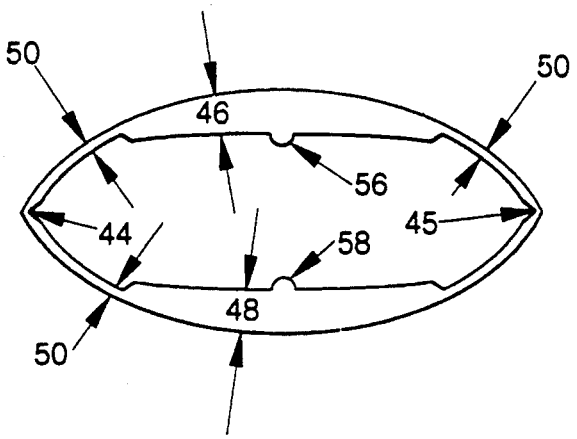
FIG. 5 is a schematic cross-sectional view of an extensible stay of the present invention.
Figure 6:
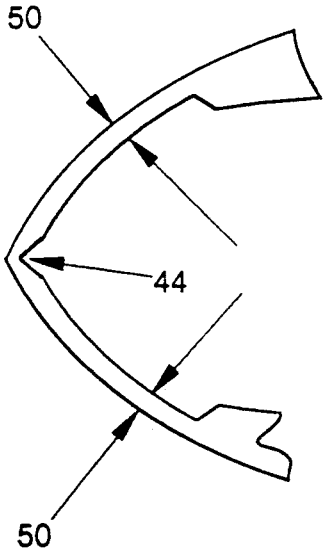
FIG. 6 is an enlarged partial schematic cross-sectional view of the hinge portion of the extensible stay illustrated in FIG. 6.

Referring to FIGS. 5 and 6, the extensible stay 40 is a continuous one-piece loop having a generally circular configuration. The stay 40 preferably has a width of 1.0 inch and a circumference of 8.0 inches. The continuous one-piece loop construction of extensible stay 40 is preferably made by extruding a thermoplastic material such as high density polyethylene (HDPE). Other materials such as nylon or low density polyethylene (LDPE) may also be used as the stay material. The stay 40 preferably includes a pair of opposed hinges generally indicated as 44 and 45. Opposed hinges 44 and 45 are preferably thinner in thickness than the remaining portions of the stay 40. Opposed hinges 44 and 45 preferably comprise a "V" shaped notch, seen in FIG. 6. The "V" shaped notches of hinges 44 and 45 preferably have an interior angle in the range of about 35°–90°. The interior angle of the "V" shaped notches of hinges 44 and 45 can be varied to modify the opening and flexibility characteristics of the stay 40. For example, as the interior angle of the "V" shaped notch increases, the flexibility of the stay 40 increases. In addition, the depth of the "V" shaped notch can also be varied to modify the opening and flexibility characteristics of the stay 40. Preferably the stay 40 has a thickness in a range of about 0.006 to 0.012 inches between the apex of "V" shaped notch to the outer surface of the stay 40. As the depth of the "V" shaped notch increases the flexibility of the stay 40 increases. Opposed hinges 44 and 45 will be aligned with the peripheral edges 16 and 17, respectively, of flexible pouch 10 when stay 40 is attached to the inner surface of the pouch's throat area 42.

Stay 40 preferably includes four relatively thin-walled transition sections generally indicated as 50. Thin-walled transition sections 50 preferably have a thickness in the range of about 0.012 to 0.016 inches. Thin-walled transition sections 50 connect hinges 44 and 45 with thick-walled sections 46 and 48, described below. The thin-walled transition sections 50 permit greater expansion of stay 40. The thin-walled transition sections 50 allow the stay 40 to expand to a nearly circular configuration under the hydrostatic pressure of water added to the pouch during the reconstituting process, described below. The thickness of the thin-walled transition sections 50 can be varied to modify the opening and flexibility characteristics of the stay 40. For example, as the thickness of thin-walled transition section 50 increases, stay 40 becomes increasingly rigid, thus restricting the ability of stay 40 to expand. In addition, the thickness of the thin-walled transition sections 50 can be varied so that it does not produce a uniform thickness substantially across its entire length. For example, the thin-walled transition section can be thinnest near the hinges 44 and 45, and can increase in thickness as they approach the thick-walled sections, described below.

The stay 40 preferably includes two opposed thick-walled sections generally indicated as 46 and 48. Opposed thick-walled sections 46 and 48 preferably have a thickness in the range of about 0.045 to 0.056 inches. Opposed thick-walled sections 46 and 48 provide the initial opening force for the self-expanding feature of stay 40. The opposed thick-walled sections preferably generate a minimal opening force of 400 grams. The thickness of opposed thick-walled sections 46 and 48 can also be varied to modify the opening and flexibility characteristics of the stay 40. For example, as the thickness of opposed thick-walled sections 46 and 48 is increased, the opening force of stay 40 increases. When attached to pouch 10, the opposed thick-walled sections 46 and 48 of extensible stay 40 are substantially aligned with the front and back sidewall panels 12 and 14.

The stay 40 preferably includes two ribs generally indicated as 56 and 58. Ribs 56 and 58 preferably have a diameter in the range of about 0.0625 to 0.125 inches. Ribs 56 and 58, which are preferably aligned with one another, prevent the inner surfaces of stay 40 from coming into intimate contact and sticking together when stay 40 is in a stressed, collapsed configuration. When pouch 10 contains a product having a relatively high viscosity two opposed ribs are generally preferred. However, when the viscosity of the product contained within pouch 10 is relatively low, a single rib on stay 40 will, in most instances, function in the intended manner.

Pouch 10 assumes a generally flat configuration after it has been formed, filled, and sealed as shown in FIGS. 1 and 2. In use, a consumer grasps pouch 10 and removes top portion 36 by tearing sidewall panels 12 and 14 along line of weakness 38. After top portion 36 has been removed from pouch 10 as shown in FIG. 3, stay 40 expands outwardly to its unstressed configuration, which is preferably circular in shape. The self-expanding action of stay 40 causes throat area 42 of pouch 10 to open up and expand into a generally tubular configuration without the consumer having to insert his fingers or a utensil into throat area 42 to pry sidewall panels 12 and 14 apart. The consumer then pours or "milks" out the concentrated product contained within pouch 10 into a large container and then, after self-opening, uses pouch 10 to accurately measure the amount of fluid that needs to be added to the large container for proper reconstitution.

Figure 4:
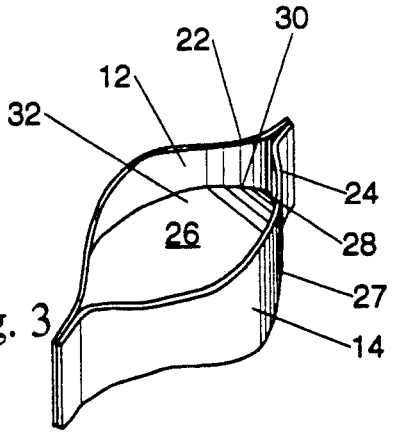
FIG. 4 is an enlarged partial schematic, perspective view of the bottom gusset portion of a flexible pouch of the present invention shown in its expanded configuration.

When a reconstituting fluid is placed inside pouch 10, bottom gusset panel 26 unfolds and drops downward such that midsection 32 assumes a generally planar configuration, as shown in FIGS. 3 and 4. Simultaneously, the fluid within pouch 10 further expands throat area 42 into a circular configuration, and also expands the lower portion of flexible sidewall panels 12 and 14 such that, combined with the unfolding and expanding action of bottom gusset 26, bottom portion 28 of pouch 10 expands into a generally tubular configuration. Pouch 10 has then expanded into a predetermined, generally tubular configuration with a predictable and repeatable internal volume such that it can be conveniently used as the means for accurately measuring the amount of fluid necessary for properly reconstituting the concentrated product. In addition, spread-apart bottom peripheral edges 22 and 24 of sidewall panels 12 and 14, respectively, cooperate to provide a stable base upon which pouch 10 is able to stand on its own on a flat surface.

Although particular embodiments of the present invention have been shown and described, modifications may be made to the flexible pouch without departing from the teachings of the present invention. The terms used in describing the invention are used in their descriptive sense and not as terms of limitation, it being intended that all equivalents thereof be included within the scope of the appended claims.

What is claimed is:

1. In a sealed, self-expanding, flexible pouch having front and back sidewall panels superimposed upon one another and having their innermost surfaces sealed together along the centrally located portion of their side peripheral edges to form a body portion of said pouch, their innermost surfaces sealed together along their top peripheral edge and along the uppermost portion of their side peripheral edges to form a top portion of said pouch, and their innermost surfaces secured in sealed relation to one another along their bottom peripheral edges and along the lowermost portion of their side peripheral edges to form a bottom portion of said pouch, said pouch having a throat area located subjacent said top portion of said pouch, said pouch further including a continuous, one-piece extensible stay secured in fixed relation to said innermost surfaces of said front and back sidewall panels in said throat area of said pouch, said continuous, one-piece extensible having a relaxed, expanded configuration and a stressed, collapsed configuration, said stay initially being held in said stressed, collapsed configuration by said top portion of said pouch prior to removal of said top portion of said pouch, whereby said stay expands to its said relaxed, expanded configuration when said top portion of said pouch is removed, thereby automatically expanding said throat area of said pouch to an open configuration, the improvement wherein said continuous one-piece extensible stay comprises:

(a) a continuous, resilient extensible loop having a pair of opposed flexible hinges, said hinges being thinner in thickness than the remaining portions of said loop and aligned with the side peripheral edges of said pouch;

(b) a pair of opposed flexible thick-walled sections located between said opposed hinges, said opposed thick-walled sections and the resiliency of the loop provide an automatic opening force for said pouch, one of said thick-walled sections being substantially aligned with said front sidewall panel of said pouch and the other of said thick-walled sections being substantially aligned with said back sidewall panel of said pouch; and (c) a flexible thin-walled transition section connecting the opposing ends of each of said thick-walled sections to one of said hinges in said extensible loop, said thin-walled transition section having a maximum thickness which is less than the thickness of said thick-walled sections; said hinges, said thin-walled transition section, and said thick-walled sections cooperating to permit said stay to expand to a nearly circular configuration upon removal of said top portion of said pouch.

2. The extensible stay according to claim 1 wherein said extensible stay is made by extruding a continuous tube comprised of thermoplastic material and thereafter slicing said continuous tube perpendicular to its axis to form said stay.

3. The extensible stay according to claim wherein said opposed hinges comprise a "V" shaped notch.

4. The extensible stay according to claim 3 wherein said "V" shaped notch in said opposed hinges exhibits an interior angle in the range of about 35° to 90°, as measured when said stay is in its relaxed, expanded condition.

5. The extensible stay according to claim 1 further comprising at least one rib on said opposed thick-walled sections to prevent said thick-walled sections from sticking to one another.

6. The pouch according to claim 1 wherein said bottom portion of said pouch comprises the lowermost portion of the side peripheral edges of said front and back sidewalls and a bottom gusset panel continuously connected to said front and back sidewall panels, said gusset panel initially being folded up into said pouch in a pleated arrangement, said gusset panel automatically unfolding and expanding when a reconstituting fluid is poured into said pouch after initial opening thereof, thereby expanding said bottom portion of said pouch into a substantially tubular configuration.

7. In a sealed, self-expanding, flexible pouch having front and back sidewall panels superimposed upon one another and having their innermost surfaces sealed together along the centrally located portions of their side peripheral edges to form a body portion of said pouch, their innermost surfaces sealed together along their top peripheral edge and along the uppermost portion of their side peripheral edges to form a top portion of said pouch, and their innermost surfaces secured in sealed relation along the lowermost portion of their side peripheral edges and along their bottom peripheral edge to a bottom gusset panel to form a bottom portion of said pouch, said pouch having a throat area located subjacent said top portion of aid pouch, said pouch further including a continuous one-piece extensible stay secured in fixed relation to said innermost surfaces of said front and back sidewall panels in said throat area of said pouch, said continuous one-piece extensible stay having a relaxed, expanded configuration and a stressed, collapsed configuration, said stay initially being held in said stressed, collapsed configuration by said top portion of said pouch prior to removal of said top portion of said pouch, whereby said stay expands to its said relaxed, expanded configuration when said top portion of said pouch is removed thereby automatically expanding said throat area of said pouch to an open configuration, the improvement wherein said continuous one-piece extensible stay comprises:

(a) a continuous, resilient extensible loop having a pair of opposed flexible hinges, said hinges being thinner in thickness than the remaining portions of said loop and aligned with the side peripheral edges of said pouch;

(b) a pair of opposed flexible thick-walled sections located between said opposed hinges, said opposed thick-walled sections and the resiliency of the loop provide an automatic opening force for said pouch, one of said thick-walled sections being substantially aligned with said front sidewall panel of said pouch and the other of said thick-walled sections being substantially aligned with said back sidewall panel of said pouch; and (c) a flexible thin-walled transition section connecting the opposing ends of each of said thick-walled sections to one of said hinges in said extensible loop, said thin-walled transition section having a maximum thickness which is less than the thickness of said thick-walled sections; said hinges, said thin-walled transition section, and said thick-walled sections cooperating to permit said stay to expand to a nearly circular configuration upon removal of said top portion of said pouch.

8. The extensible stay according to claim 7 wherein said extensible stay is made by extruding a continuous tube comprised of thermoplastic material and thereafter slicing said continuous tube perpendicular to its axis to form said stay.

9. The extensible stay according to claim 7 wherein said opposed hinges comprise a "V" shaped notch.

10. The extensible stay according to claim 9 wherein said "V" shaped notch in said opposed hinges exhibits an interior angle in the range of about 35° to 90°, as measured when said stay is in its relaxed, expanded condition.

11. The extensible stay according to claim 7 further comprising at least one rib on said opposed thick-walled sections to prevent said opposed thick-walled sections from sticking to one another.

12. The pouch according to claim 7 wherein said bottom gusset panel is a separate panel being sealed to said front and back sidewall panels in said bottom portion of said pouch.

13. The pouch according to claim 7 wherein said bottom gusset panel and said front and back sidewall panels are formed from a single web of material.

14. The pouch according to claim 7 wherein said gusset panel is initially folded up into said pouch in a pleated arrangement, said gusset panel automatically unfolding and expanding when a reconstituting fluid is poured into said pouch after initial opening thereof, thereby expanding said bottom portion of said pouch into a substantially tubular configuration.

15. In a sealed, self-expanding, flexible pouch having front and back sidewall panels superimposed upon one another and having their innermost surfaces sealed together along the centrally located portions of their side peripheral edges to form a body portion of said pouch, their innermost surfaces sealed together along their top peripheral edge and along the uppermost portion of their side peripheral edges to form a top portion of said pouch, and their innermost surfaces secured in sealed relation along the lowermost portion of their side peripheral edges and along their bottom peripheral edge to a bottom gusset panel to form a bottom portion of said pouch, said pouch having a throat area located subjacent said top portion of said pouch, said pouch further including a continuous, one-piece extensible stay secured in fixed relation to said innermost surfaces of said front and back sidewall panels in said throat area of said pouch, said continuous,.one-piece extensible stay having a relaxed, expanded configuration and a stressed, collapsed configuration, said stay initially being held in said stressed, collapsed configuration, said stay initially being held in said stressed, collapsed configuration by said top portion of said pouch prior to removal of said top portion of said pouch, whereby said stay expands to its said relaxed, expanded configuration when said top portion of said pouch is removed, thereby automatically expanding said throat area of said pouch to an open configuration, the improvement wherein said continuous one-piece extensible stay comprises:

(a) a continuous, resilient extensible loop, having a pair of opposed flexible hinges, said hinges being thinner in thickness than the remaining portions of said loop and aligned with the side peripheral edges of said pouch;

(b) a pair of opposed flexible thick-walled sections located between said opposed hinges, said opposed thick-walled sections and the resiliency of the loop provide an automatic opening force for said pouch, one of said thick-walled sections being substantially aligned with said front sidewall panel of said pouch and the other of said thick-walled sections being substantially aligned with said back sidewall panel of said pouch;

(c) a flexible thin-walled transition section connecting the opposing ends of each of said thick-walled sections to one of said hinges in said extensible loop, said thin-walled transition section having a maximum thickness which is less than the thickness of said thick-walled sections; said hinges, said thin-walled transition section, and said thick-walled sections cooperating to permit said stay to expand to a nearly circular configuration upon removal of said top portion of said pouch; and (d) at least one rib on said opposed thick-walled sections to prevent said stay from sticking together.

16. The extensible stay according to claim 15 wherein at least one rib on said opposed thick-walled sections comprises two ribs.

17. The extensible stay according to claim 15 wherein said extensible stay is made by extruding a continuous tube comprised of thermoplastic material and thereafter slicing said continuous tube perpendicular to its axis to form said stay.

18. The extensible stay according to claim 15 wherein said opposed hinges comprise a "V" shaped notch.

19. The extensible stay according to claim 18 wherein said "V" shaped notch in said opposed hinges exhibit an interior angle in the range of about 35° to 90°, as measured when said stay is in its relaxed, expanded condition.

20. The pouch according to claim 15 wherein said bottom gusset panel and said front and back sidewall panels are formed from a single web of material.

* * * * *

UNITED STATES PATENT AND TRADEMARK OFFICE

CERTIFICATE OF CORRECTION

PATENT NO. : 5,184,896

DATED : Feb. 9, 1993

INVENTOR(S) : Edward P. Hammond; Daniel J Kinne, George L. Roseberry

It is certified that error appears in the above-identified patent and that said Letters Patent is hereby corrected as shown below:

Column 8, line 51, after "claim" insert -- 1 --.

Column 9, line 18, "aid" should read -- said --.

Column 10, lines 38-39, delete "said stay initially being held in said stressed, collapsed configuration,".

Signed and Sealed this

Seventh Day of December, 1993

*Attest:*

*Attesting Officer*

BRUCE LEHMAN

*Commissioner of Patents and Trademarks*